US007044772B2

(12) United States Patent
McCreery et al.

(10) Patent No.: US 7,044,772 B2
(45) Date of Patent: May 16, 2006

(54) ELECTRICAL CONNECTOR AND CABLE ASSEMBLY

(75) Inventors: Terence E. McCreery, Chicago, IL (US); Daniel A. Harps, Western Springs, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/857,827

(22) Filed: Jun. 1, 2004

(65) Prior Publication Data

US 2005/0266724 A1 Dec. 1, 2005

(51) Int. Cl.
*H01R 12/24* (2006.01)

(52) U.S. Cl. ..... 439/493

(58) Field of Classification Search ..... 439/492–493, 439/499, 495, 449, 595, 496
See application file for complete search history.

(56) References Cited

U.S. PATENT DOCUMENTS 4,581,495 A 4/1986 Geri et al. ..... 179/179
4,781,609 A 11/1988 Wilson et al. ..... 439/215
4,927,387 A 5/1990 Eckler et al. ..... 439/499
5,453,024 A 9/1995 Patinier ..... 439/410
5,980,307 A 11/1999 Brewster et al. ..... 439/493
6,039,600 A 3/2000 Etters et al. ..... 439/496
6,383,015 B1 5/2002 Mochizuki et al. ..... 439/492
6,558,186 B1 5/2003 LePottier et al. ..... 439/496

*Primary Examiner*—Javaid H. Nasri
(74) *Attorney, Agent, or Firm*—Stephen Z. Weiss

(57) ABSTRACT

An electrical connector and cable assembly includes a flat flexible cable having a plurality of parallel conductors with insulation around and between the conductor. The insulation has at least one opening therethrough between a pair of adjacent conductors. A plurality of conductive terminals having terminating portions are respectively terminated to the distal ends of the conductors. A dielectric housing has a receptacle for receiving the one end of the cable and including at least one projection extending into the opening in the web of the cable to provide strain relief therefor. A plurality of stub walls extend between the terminating portions of the terminals to electrically isolate the terminating portions of adjacent terminals.

15 Claims, 3 Drawing Sheets

ELECTRICAL CONNECTOR AND CABLE ASSEMBLY

FIELD OF THE INVENTION

This invention generally relates to the art of electrical connectors and, particularly, to an electrical connector and cable assembly which includes a flat flexible or ribbon cable.

BACKGROUND OF THE INVENTION

Electrical cable assemblies are used in a variety of applications and may extend from various panels, circuit boards or other electrical components. The cable assembly includes a flat flexible cable having a plurality of generally parallel conductors with insulation disposed around and between the respective conductors. Electrical connectors are terminated to one or both ends of the flat flexible cable to form a cable assembly.

For instance, in order to electrically interconnect adjacent wall panels, power blocks from each panel are electrically joined by a flat flexible electrical cable assembly. Heretofore, a pair of rigid dielectric connector housings have been joined by a flat flexible cable as described above. A plurality of terminals are electrically connected to the conductors of the cable and are then over-molded by the connector housing. These flat flexible cable assemblies of the prior art are expensive to manufacture due to high material and labor costs. The present invention is directed to satisfying a need to provide flat flexible cable assemblies which are less expensive to manufacture.

SUMMARY OF THE INVENTION

An object, therefore, of the invention is to provide new and improved connector and cable assemblies of the character described.

In the exemplary embodiment of the invention, the assembly includes a flat flexible cable having a plurality of parallel conductors with a web of insulation around and between the conductors. The web of insulation has at least one opening therethrough between a pair of adjacent conductors. A plurality of conductive terminals are respectively terminated to the distal ends of the conductors. A dielectric housing has receptacle means for receiving the one end of the cable and includes at least one projection extending into the opening in the web of the cable to provide strain relief therefor. A plurality of stub walls extend from the housing between the distal ends of the conductors to electrically isolate the terminals.

As disclosed herein, the stub walls project between the conductors and terminals to prevent electrical arcing therebetween. The dielectric housing includes a base and a cover to enclose the receptacle means. The cover is joined to the base by an integral flexible hinge. The projection extends from the base through the opening in the web of the cable and includes a latch portion for latching the cover to the base. The stub walls extend from the base between the conductors and the terminals and the cover includes pairs of ribs on the inside thereof for receiving top edges of the stub walls therebetween to form completely enclosed compartments for the exposed ends of the conductors and the terminals.

Preferably, a plurality of the openings are provided through the web of the cable between a plurality of pairs of adjacent conductors. The openings receive a plurality of the projections, and some of the projections include latch portions for latching the cover to the base.

Other features of the invention include the terminals having terminating portions located in the receptacle means for electrical termination to the exposed conductors. The terminals have mating portions extending from the receptacle means into a mating portion of the connector. The terminating portions are bifurcated for clamping onto the exposed conductors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
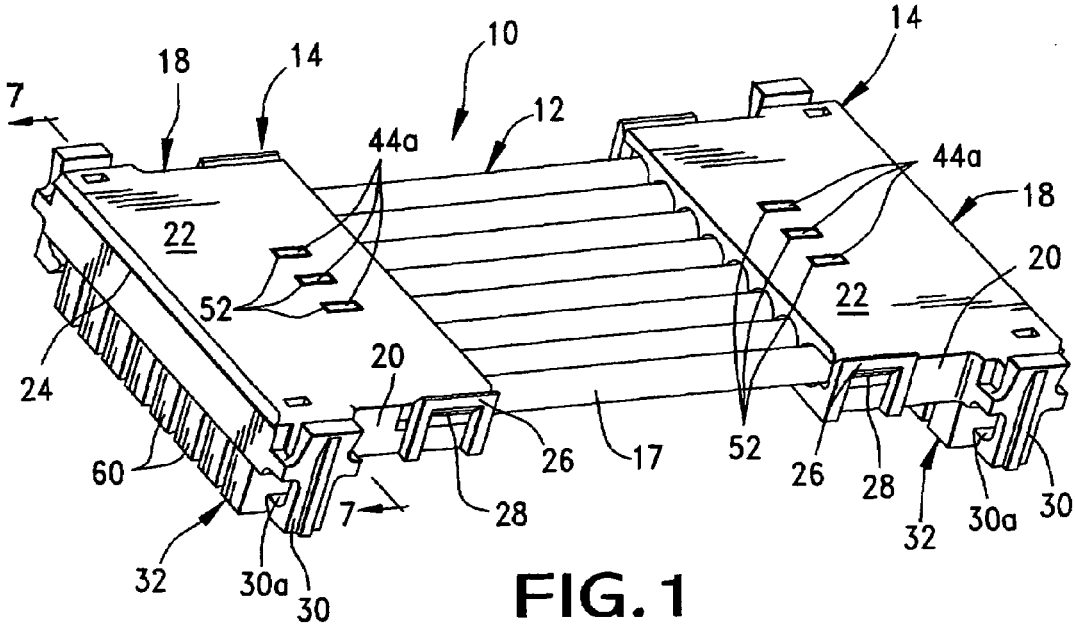
FIG. 1 is a perspective view of a flat flexible cable assembly according to the invention, with a pair of connectors at opposite ends of the flat flexible cable.
Figure 2:
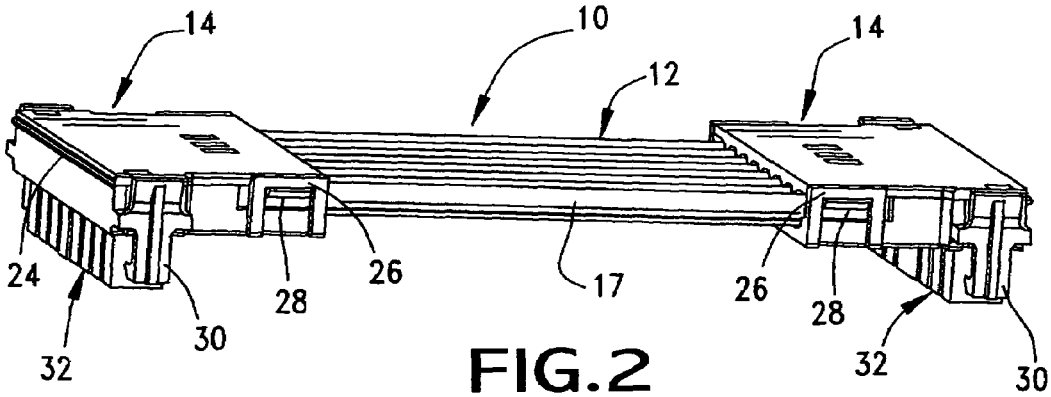
FIG. 2 is a perspective view of the assembly of FIG. 1, taken more at a side angle thereto and incorporating a longer flat flexible cable.

Referring to the drawings in greater detail, and first to FIGS. 1 and 2, the invention is illustrated in a flat flexible cable assembly, generally designated 10, which includes a flat flexible cable, generally designated 12, which has a pair of identical connectors, generally designated 14, terminated to opposite ends of the cable. Suffice it to say at this point, flat flexible cable 12 includes a plurality of conductors which are electrically connected or terminated at opposite ends of the cable by connectors 14. The conductors are enclosed by an insulation 16 around the conductors and a web of insulation (seen hereinafter) between adjacent conductors.

Figure 3:
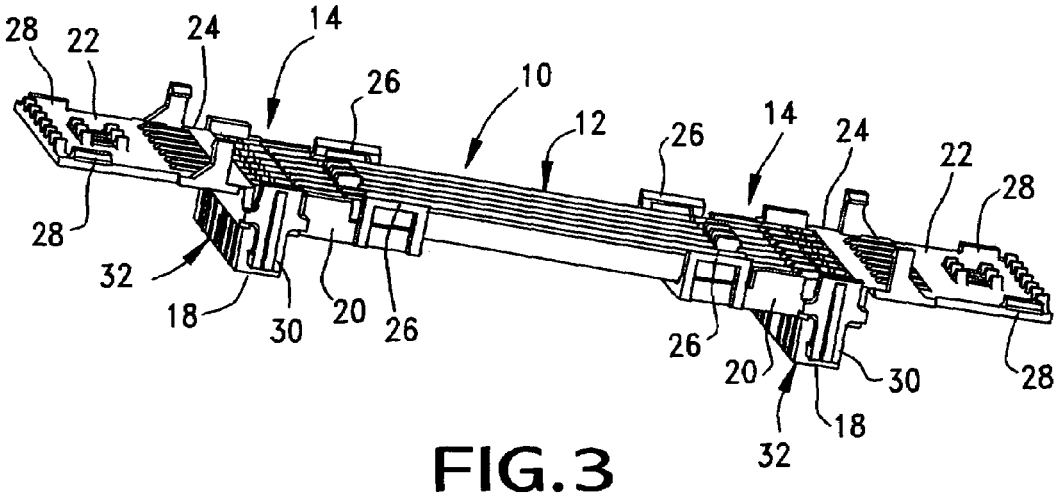
FIG. 3 is a side perspective view of the assembly, with the covers of the connectors in open positions.
Figure 4:
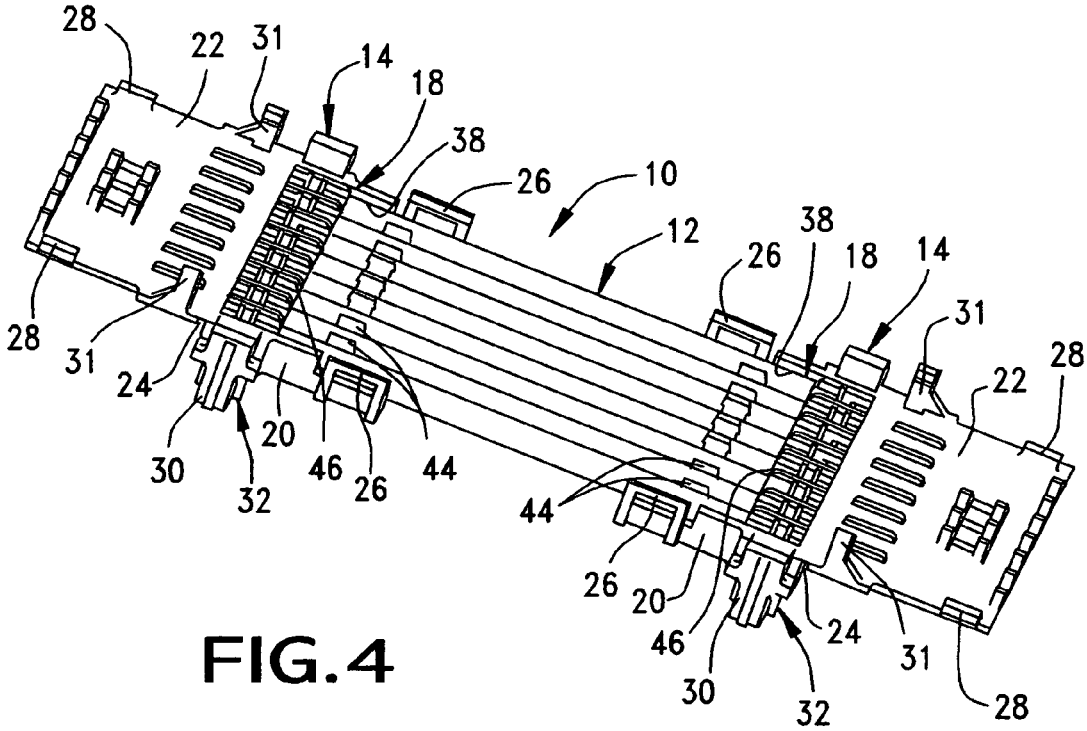
FIG. 4 is a top perspective view similar to that of FIG. 3.

Referring to FIGS. 3 and 4 in conjunction with FIGS. 1 and 2, each connector 14 includes a dielectric housing, generally designated 18, which includes a base 20 and a cover 22. The housing is a one-piece structure molded of dielectric plastic material, with the cover integrally joined to the base by a flexible or "living" hinge 24 (also seen FIGS. 1 and 2). Therefore, the cover is pivotally mounted to the base for movement about hinge 24 from an open position shown in FIGS. 3 and 4 to a closed position shown in FIGS. 1 and 2. The base has a pair of flexible latch bars 26 at opposite sides thereof for snap-latching engagement with a pair of latch hooks 28 at opposite sides of cover 22. The cover also has a pair of latch arms 30, having hooked portions 30*a* for latching engagement with a complementary mating connector (not shown). To that end, base 20 of housing 18 includes a mating portion, generally designated 32, for mating with the complementary mating connector in a direction generally perpendicular to the flat flexible cable. The cover has a pair of hooked latch arms 31 for latching engagement with a pair of latch shoulders (not visible in the drawings) behind latch arms 30.

Figure 5:
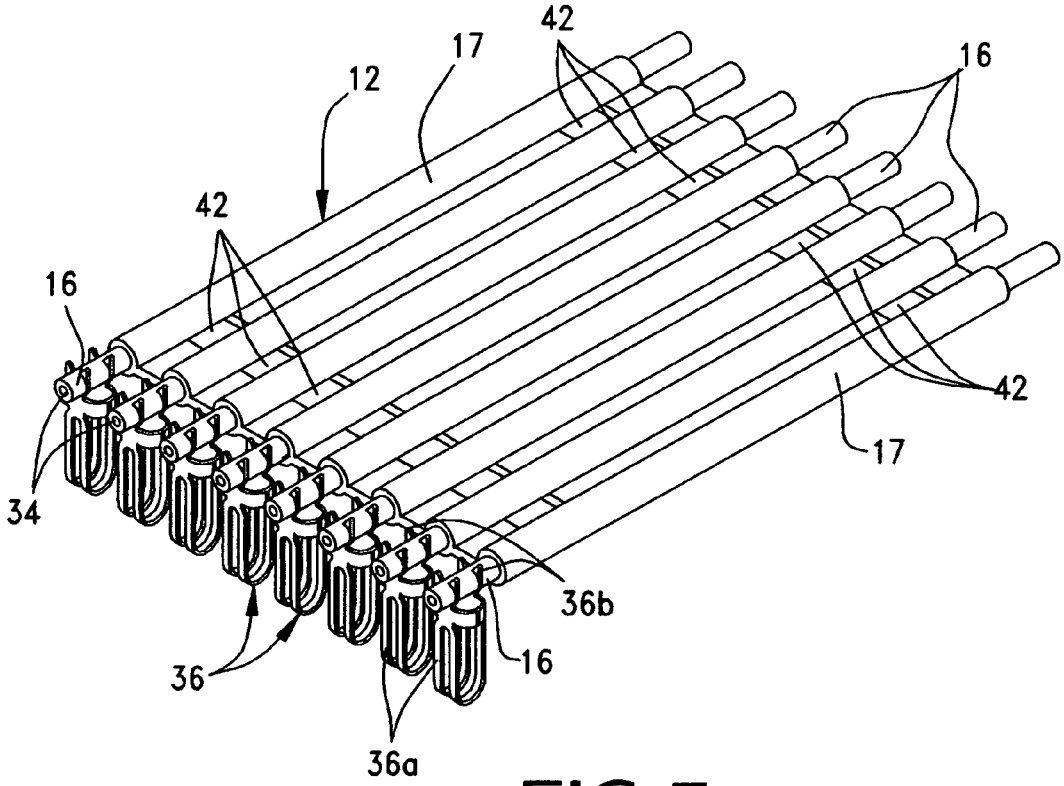
FIG. 5 is a perspective view showing the flat flexible cable with a plurality of terminals terminated to the exposed conductors of the cable at one end thereof.

Before proceeding with further details of connector 14 and particularly housing 18 of the connector, reference is made to FIG. 5 which shows flat flexible cable 12 in a condition prepared for termination in the connectors. Specifically in the preferred embodiment, secondary insulation 17 at opposite ends of the cable is removed to expose distal ends of the primary insulation 16 surrounding the conductors 34 and openings 42 are formed in the secondary insulation 17. A plurality of conductive terminals, generally designated 36, are electrically connected or terminated to the conductors 34 by passing through and displacing the exposed primary insulation 16. Each terminal 36 includes an elongated, bifurcated mating portion 36*a*. The bifurcated mating portions extend into mating portion 32 of housing 18 in a direction generally perpendicular to the flat flexible cable, as is clearly seen in FIG. 5. Each terminal also includes a bifurcated terminating portion 36*b* which is electrically engages a respective one of the conductors 34 through the insulation. In an alternative embodiment (not shown), the primary and secondary insulation are removed from opposite ends of the cable to expose distal ends of the conductors. The exposed conductors are press fit into the bifurcated terminating portions 36*b*.

Figure 6:
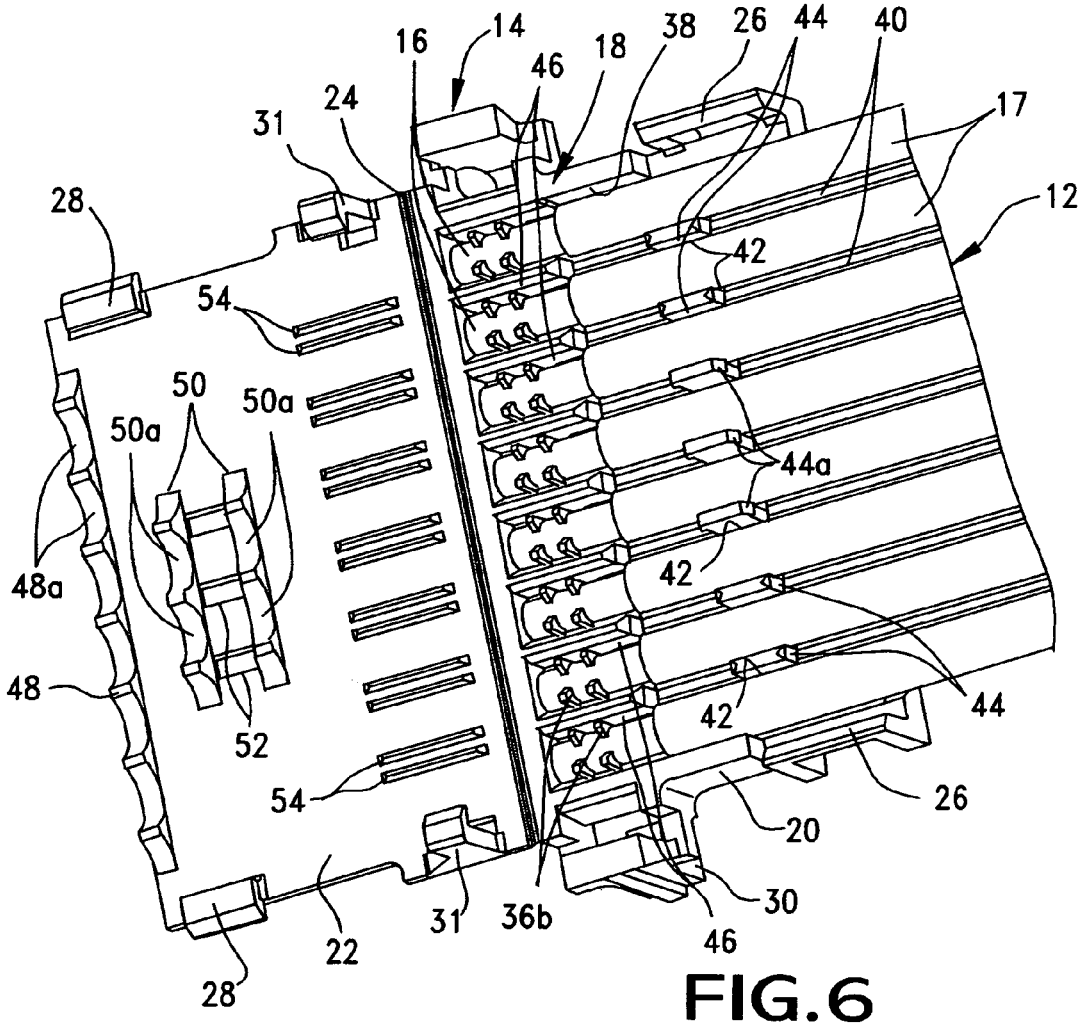
FIG. 6 is a top perspective view of the subassembly of FIG. 5 mounted in one of the connectors, with the cover of the connector in open position.

FIG. 6 shows the subassembly of FIG. 5 mounted in a receptacle 38 in the top of base 20 of housing 18, with cover 22 of the housing in its open position. Terminating portions 36*b* of terminals 36 (FIG. 5) can be seen in FIG. 6. FIG. 6 also shows that secondary insulation 17 of flat flexible cable 12 has a web 40 of insulation between each adjacent pair of conductors. The webs have openings 42.

Still referring to FIG. 6, base 20 of housing 18 includes a plurality of projections 44 which extend upwardly into receptacle 38 and through openings 42 in webs 40 of flat flexible cable 12. This provides strain relief for the cable and prevents the cable from pulling out of connector 14 when cover 22 is closed. The base also has a plurality of stub walls 46 which also project upwardly in receptacle 38 between exposed conductors 34 and terminating portions 36*b* of adjacent terminals 36 to prevent electrical arcing therebetween. Finally, the three center-most projections 44 have enlarged latch heads 44*a* to facilitate latching the cover to the base as will be seen hereinafter.

Cover 22 of housing 18 has a pressure flange 48 along a free edge of the cover. The flange has undulations 48*a* for pressing down on the flat flexible cable within base 20 of the housing. Undulations 48*a* are aligned with some of the conductors of the cable. Similarly, a pair of centrally located pressure flanges 50 on the inside surface of the cover have undulations 50*a* for pressing down on the cable. The cover has three latch holes 52 at the center thereof, for purposes described hereinafter. Finally, cover 22 has pairs of ribs 54 on the inside surface thereof aligned with stub walls 46 of the base.

When cover 22 is closed onto base 20, several things occur. First, latch hooks 28 engage and latch into flexible latch bars 26 to hold the cover in its closed position as shown in FIGS. 1 and 2. In the closed position, pressure flanges 48 and 50 press down onto the cable. Each pair of ribs 54 embraces the top of a respective one of stub walls 46 to define completely closed compartments for the exposed ends of the conductors 34 and terminating portions 36*b* of the terminals. Finally, enlarged heads 44*a* on the three center projections 44 snap into latching engagement with latch holes 52 of the cover to hold the center of the cover downwardly onto the base.

Figure 7:
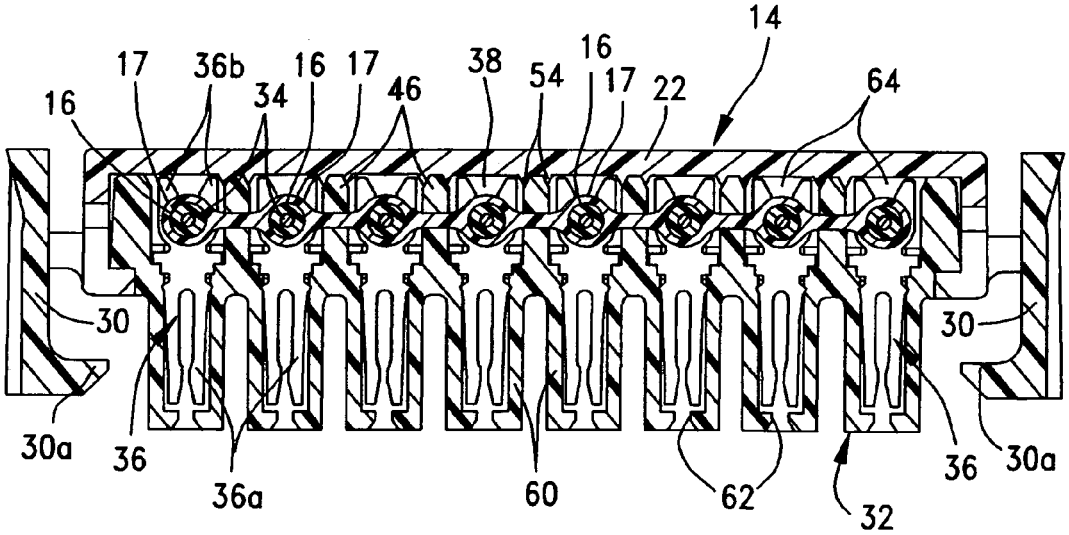
FIG. 7 is an enlarged vertical section taken generally along line 7—7 in FIG. 1.

FIG. 7 shows how bifurcated terminating portions 36*a* extend into a plurality of silos 60 of mating portion 32 of connector 14. The distal end of the silos have openings 62 for receiving terminals from the complementary mating connector (not shown). Bifurcated terminating portion 36*b* of the terminals can be seen embracing conductors 34 of the flat flexible cable through the primary insulation 16. Stub walls 46 project upwardly between adjacent conductors as well as between terminating portions 36*b* of the terminals. Ribs 54 of cover 22 can be seen embracing the top edges of the stub walls so that completely enclosed compartments 64 are formed for the exposed conductor ends and the bifurcated terminating portions of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector and cable assembly, comprising:

a flat flexible cable including a plurality of parallel conductors with insulation around the conductors and a web of insulation between adjacent conductors, the web of insulation having at least one opening therethrough between a pair of adjacent conductors;

a plurality of conductive terminals respectively terminated to distal ends of the conductors;

a dielectric housing having receptacle means for receiving one end of the cable and including at least one projection extending into said at least one opening in the web of the cable to provide strain relief therefor, a plurality of stub walls extending between the exposed distal ends of the conductors to electrically isolate the conductors, and a base and cover to enclose said receptacle means, the base and cover joined by an integral flexible hinge; and said stub walls extending from the base between the terminating portions of the terminals and the conductors, and the cover including pairs of ribs on the inside thereof each pair receiving top edges of one stub wall therebetween to form completely enclosed compartments for the terminating portions of the terminals.

2. The electrical connector assembly of claim 1 wherein said stub walls project between said terminals to prevent electrical arcing therebetween.

3. The electrical connector assembly of claim 1 wherein said projection extends from the base through the opening in the web of insulation of the cable and includes a latch portion for latching the cover to the base.

4. The electrical connector assembly of claim 1, including a plurality of said openings through the web of insulation of the cable between a plurality of pairs of adjacent conductors for receiving a plurality of said projections.

5. The electrical connector assembly of claim 4 wherein said dielectric housing includes a base and a cover, said projections extend from the base through the openings, and some of the projections include latch portions for latching the cover to the base.

6. The electrical connector assembly of claim 1 wherein each of said terminals includes a terminating portion located in the receptacle means for electrical termination to a respective one of the conductors and a mating portion extending from the receptacle means into a mating portion of the connector.

7. The electrical connector assembly of claim 6 wherein said terminating portion is bifurcated for clamping onto the respective conductor.

8. An electrical connector and cable assembly, comprising:

a flat flexible cable including a plurality of parallel conductors with insulation around the conductors and a web of insulation between adjacent conductors, the web of insulation having plurality of openings therethrough between adjacent pairs of conductors;

a plurality of conductive terminals having terminating portions respectively terminated to the exposed distal ends of the conductors; and a dielectric housing having a base and a cover joined by an integral flexible hinge defining receptacle means therebetween for receiving said one end of the cable and including a plurality of projections extending from the base into the receptacle means and through the openings in the cable to provide strain relief therefor, some of said projections including latch portions for latching the cover to the base, and a plurality of stub walls projecting from the base into the receptacle means between the disposed distal ends of the conductors and the terminating portions of the terminals to electrically isolate the conductors and to prevent electrical arcing between the terminating portions.

9. The electrical connector assembly of claim 8 wherein said stub walls extend from the base between the terminating portions of the terminals, and the cover includes pairs of ribs on the inside thereof each pair receiving top edges of one stub wall therebetween to form completely enclosed compartments for the terminating portions of the terminals.

10. The electrical connector assembly of claim 8 wherein each of said terminals includes a terminating portion located in the receptacle means for electrical termination to a respective one of the conductors and a mating portion extending from the receptacle means into a mating portion of the connector.

11. The electrical connector assembly of claim 10 wherein said terminating portion is bifurcated for clamping onto the respective conductor.

12. An electrical connector assembly for terminating a flat flexible cable having a plurality of parallel conductors with insulation around the conductors and a web of insulation between adjacent conductors, the web of insulation having at least one opening therethrough between a pair of adjacent conductors, comprising:

a plurality of conductive terminals having terminating ends respectively terminated to distal ends of the conductors;

a dielectric housing having receptacle means for receiving one end of the cable and including at least one projection extending into said at least one opening in the web of insulation to provide strain relief therefor, and a plurality of stub walls extending between the terminating ends of the terminals to electrically isolate the terminating ends of adjacent terminals; and said dielectric housing including a base and cover joined together by an integral flexible hinge to enclose said receptacle means, the projection extending from the base through the opening in the web of insulation and including a latch portion for latching the cover to the base.

13. The electrical connector assembly of claim 12 wherein said stub walls extend from the base between the terminating ends of the terminals, and the cover includes pairs of ribs on the inside thereof each pair receiving top edges of one stub wall therebetween to form completely enclosed compartments for the terminating ends of the terminals.

14. The electrical connector assembly of claim 12, including a plurality of said openings through the web of insulation between a plurality of pairs of adjacent conductors for receiving a plurality of said projections.

15. The electrical connector assembly of claim 14 wherein said dielectric housing includes a base and a cover, said projections extend from the base through the openings, and some of the projections include latch portions for latching the cover to the base.

* * * * *